US006210636B1

(12) United States Patent
Klein

(10) Patent No.: US 6,210,636 B1
(45) Date of Patent: Apr. 3, 2001

(54) CU-NI-ZN-PD ALLOYS

(75) Inventor: Arthur S. Klein, Orange, CT (US)

(73) Assignee: The J. M. Ney Company, Bloomfield, CT (US)

( * ) Notice: Subject to any disclaimer, the term of this patent is extended or adjusted under 35 U.S.C. 154(b) by 0 days.

(21) Appl. No.: 09/303,244

(22) Filed: Apr. 30, 1999

(51) Int. Cl.[7] ..... C22C 9/04; C22C 9/06; C22C 30/00

(52) U.S. Cl. ..... 420/481; 420/587; 148/413; 148/414; 148/419

(58) Field of Search ..... 420/587, 477, 420/481, 483; 148/442, 419, 434, 413, 435, 414

(56) References Cited

U.S. PATENT DOCUMENTS 4,396,578 8/1983 Bales ..... 420/587
4,557,895 * 12/1985 Karamon et al. ..... 420/587
5,409,663 * 4/1995 Taylor et al. ..... 420/587
5,484,569 1/1996 Klein et al. ..... 420/503
5,833,774 11/1998 Klein et al. ..... 148/442

* cited by examiner

*Primary Examiner*—Deborah Yee
(74) *Attorney, Agent, or Firm*—McDermott, Will & Emery

(57) ABSTRACT

A family of copper-nickel-zinc-palladium alloys for sliding and static electrical contact applications comprises, on a weight percent basis, about 15–65 percent copper, up to about 30 percent nickel, about 5–30 percent zinc, about 5–45 percent palladium, and up to about 35 percent silver. One embodiment of the family of alloys is age hardenable and provides alloys with hardness values in excess of 300 Knoop (100g load) and significant improvement in high-temperature properties, formability, tensile strength and ductility. A second embodiment provides an alloy with increased strength and hardness in the wrought condition, relative to the prior art Cu—Ni—Zn alloys.

9 Claims, No Drawings

CU-NI-ZN-PD ALLOYS

TECHNICAL FIELD OF THE INVENTION

The present invention relates to alloys which are useful in sliding electrical contact applications.

BACKGROUND OF THE INVENTION

In many potentiometric position-sensing applications, sliding electrical contacts must perform reliably in harsh environments and must be resistant to mechanical wear and also contribute little or no electrical noise over the lifetime of the device. Since the useful lifetime of these low current, low voltage devices is often measured in terms of millions to tens of millions of full cycle rotations and tens to hundreds of millions of dither cycles, the contacts are often made from relatively high cost, high strength alloys containing mixtures of noble metals, such as gold, platinum, and palladium. Since noble metals by themselves do not have sufficient strength for these demanding applications, they are often alloyed with moderate levels of elements such as copper and silver, which provide strength but allow the alloys to maintain the excellent tarnish and oxidation resistance typical of the noble metals. Examples of these demanding applications include automotive fuel level senders, automotive throttle position sensors, and exhaust gas recirculation (EGR valve) sensors. These applications often require exposure to corrosive environments and/or to elevated temperatures. U.S. Pat. Nos. 5,833,774 and 5,484,569 to Klein et. al. disclose compositions of silverl/palladium/copper alloys which are used in such applications.

The cost of these alloys is directly related to the relative amounts of noble elements contained in the alloy. Until recently, palladium was the least costly of the noble metals with a cost roughly one third to one half that of gold and platinum. For that reason, palladium-based alloys such as PALINEY® 6 and PALINEY® 7, manufactured by the J. M. Ney Company, were widely used in high reliability potentiometric applications. However, since palladium-based alloys were still much more costly than alloys based on copper or nickel, designers were often forced to reduce the size of palladium-based alloy contacts to remain cost-competitive. In recent years, the cost of palladium has risen so dramatically that it is now roughly equivalent to platinum and more costly than gold. Because of this dramatic increase, there is now a demand for sliding electrical contact materials with reduced palladium levels without compromising the strength and hardness typical of alloys having greater amounts of palladium.

For many of the miniaturized sliding contact applications, the alloy is used as both a cantilever-type spring member and as a low electrical noise contact. The force of a cantilever spring is proportional to the elastic modulus, and limited by the yield strength, of the material used for the contact. A spring member is used to maintain electrical continuity across the sliding contact interface. Any disruption of that continuity results in an electrical spike, or electrical noise. For low yield strength materials, the spring force is maintained by increasing the cross sectional area of the spring member. As the cost of the alloy used for the spring member increases, designers look for lower cost, higher strength materials to perform this function.

Commercially available copper-nickel-zinc alloys are well known and are frequently referred to as "nickel silver" alloys because of their white or silvery color, even though they contain no silver. These alloys are typically used for hardware, optical parts, jewelry, mechanical springs, and sliding contact applications in which electrical noise and wear are not considered detrimental. Although they are relatively inexpensive, their suitability for use as high-precision miniature sliding potentiometric contacts is limited by their relatively low strength and hardness, poor tarnish resistance, and tendency to wear. In sliding applications, the resultant wear debris can be a source of electrical noise. Additionally, the prior art "nickel silver" alloys are known to have poor stress relaxation characteristics, and thus their utility in elevated temperature applications is limited. In order to be used as a cantilever spring contact, the prior art "nickel silver" alloys require relatively large cross sectional areas to carry a given load. This large size requirement, along with their relatively poor wear resistance, poor stress relaxation, and tendency to produce wear debris and create electrical noise, severely limits the use of these alloys as sliding contacts in precision potentiometric sensors.

The prior art commercially available copper-nickel-zinc alloys are single phase, solid solution alloys that can only be strengthened by cold working the alloy after it has been cast. As a wrought (i.e., cold worked only) material, these alloys have limited ductility in the harder tempers. In general, for wrought alloys, ductility decreases as the tensile strength increases. Additionally, for these alloys, the only way to regain ductility is to heat or anneal the alloy, which reduces the strength of the alloy.

In contrast to the strengthening mechanism of cold working, age hardening as a strengthening mechanism provides an alloy having both high strength and sufficient ductility to allow for complex forming operations. For age hardening to occur, the alloy should be formulated to have a stable multi-phase microstructure at low (ambient) temperatures. In addition, one or more of the phases should go into solution at an elevated temperature.

Age hardening involves heating an alloy to a temperature at which at least some of the solute elements are in solid solution, and then cooling the alloy sufficiently quickly to ensure that the solutes remain in solution, followed by re-heating at an intermediate temperature. During this re-heating or aging step, certain of the constituent elements will precipitate to form a second phase within the matrix. The precipitated phase can have a different crystal structure from that of the matrix phase. During aging, the hardness and yield strength of the alloy increase to a maximum value when the precipitated phase reaches an optimum size and distribution. In contrast to wrought-only strengthened alloys, the aging process can also increase ductility while it strengthens the cold-worked alloy. Age hardening can also increase the strength of annealed (solutionized) alloys while maintaining good ductility. These properties are of primary interest in alloys that are used for miniature, cantilever beam—type sliding electrical contacts.

Prior art "nickel-silver" alloys are not known to be age hardenable. They achieve only moderate strength and hardness levels, low elongation, and relatively poor ductility typical of a wrought alloy. Additionally, the "nickel-silver" alloys are not known to be particularly resistant to elevated temperature stress relaxation, environmental tarnish, or oxidation. All of these are important properties for miniature sliding contacts used in automotive and other demanding position sensor applications.

It would therefore be advantageous to provide a copper-based alloy for use in sliding, static and other electrical contact applications requiring high strength. It would be fiurther advantageous if superior mechanical properties could be achieved with a material of a lower unit cost than the prior art silver-palladium alloys.

SUMMARY OF THE INVENTION

The present invention is directed to a family of copper-nickel-zinc-palladium alloys which are suitable for use in miniature sliding electrical contacts. The alloys of the present invention have increased strength, hardness, formability, and stress relaxation performance when compared to commercially available copper-nickel-zinc alloys, and these advantages make the alloys of the invention suitable for electrical contact applications in which high hardness, high wear resistance, low electrical noise characteristics, and good elevated temperature mechanical properties are required. The high mechanical strength and hardness associated with the alloy of the present invention can be obtained in a wrought material. If additional strength, improved formability, or better stress relaxation properties are desired, these properties can be obtained in one of the age hardenable variations of the alloys of the invention.

According to one aspect of the invention, a copper-nickel-zinc-palladium alloy comprises, by weight, about 15–65 percent copper, up to about 30 percent nickel, about 5–30 percent zinc, about 5–45 percent palladium, and up to about 35 percent silver. These alloys provide increased strength and hardness values in a wrought state relative to prior art commercially available copper-nickel-zinc alloys.

According to another aspect of the invention, an age hardenable copper-nickel-zinc-palladium alloy comprises, by weight, about 30–65 percent copper, about 5–30 percent nickel, about 5–20 percent zinc, about 5–45 percent palladium, and up to about 10 percent silver.

In a preferred embodiment of the age hardenable alloy, silver comprises no more than about 5 percent by weight, and zinc comprises at least 6 percent by weight.

The alloy can further include minor amounts (up to about 1 percent by weight) of one or more elements selected from the group consisting of gold, antimony, germanium, cobalt, tin, ruthenium, zirconium, chromium and boron. A minor amount (less than about 1 percent by weight) of one or more grain refining elements, such as rhenium and iridium, may also be added.

A preferred composition range for the age hardenable alloy includes, by weight, about 35–60 percent copper, about 9–25 percent nickel, about 7.5–15 percent zinc, about 15–40 percent palladium, and up to about 5 percent silver.

A preferred composition for the age hardenable alloy consists essentially of, by weight, about 47.5 percent copper, about 19.56 percent nickel, about 9.78 percent zinc, and about 23.16 percent palladium.

According to another aspect of the invention, both sliding and static electrical contacts are made from a Cu—Ni—Zn—Pd alloy comprising, by weight, about 15–65 percent copper, up to about 30 percent nickel, about 5–30 percent zinc, about 5–45 percent palladium, and up to about 35 percent silver.

According to still another aspect of the invention, both sliding and static electrical contacts are made from an age hardenable Cu—Ni—Zn—Pd alloy comprising, by weight about 30–65 percent copper, about 5–30 percent nickel, about 5–20 percent zinc, about 5–45 percent palladium, and up to about 10 percent silver.

These and other objects and advantages of the invention will in part be obvious and will in part appear hereinafter. The invention accordingly comprises the apparatus possessing the construction, combination of elements and arrangement of parts which are exemplified in the following detailed disclosure, the scope of which will be indicated in the claims.

DETAILED DESCRIPTION OF THE PREFERRED EMBODIMENTS

The alloys of the present invention can contain copper, nickel, zinc, silver and palladium. One embodiment containing copper, zinc and palladium features superior mechanical properties in the wrought state, relative to commercially available copper-nickel-zinc alloys. These alloys may also include nickel and silver.

A second embodiment features an age hardenable alloy and contains copper, nickel, zinc and palladium. These alloys may include a small amount of silver, not to exceed about 10 percent by weight, and minor amounts (less than about 1 percent by weight) of other elements, such as gold, antimony, germanium, cobalt, tin, ruthenium, zirconium, chromium and boron. One or more grain refining elements may also be added in small amounts, not to exceed 1 percent by weight. Two preferred grain refining elements include, for example, rhenium and iridium.

Some of the alloys of the present invention can be age hardened, in contrast to known commercially available copper-nickel-zinc alloys, to achieve the desired hardness and tensile strength values. Age hardening is made possible by the presence of second phase enriched in palladium and zinc, and lower amounts of silver in the matrix of the second phase. To ensure satisfactory age hardening, the alloy should contain at least 6 percent zinc and not more than about 10 percent silver, and preferably not more than about 5 percent silver. Additional alloy compositions which offer significant strength and hardness improvements over those of commercially available copper-nickel-zinc alloys are considered to be within the scope of the invention.

As previously mentioned, wrought alloys generally begin to lose ductility and are difficult to form as their strength and hardness levels increase. However, the alloys of the present invention show good ductility in both the as-annealed and the age hardened condition. In a severely cold worked condition, the alloys of the present invention show low ductility typical of all wrought alloys. However, in the severely cold worked condition, the alloys of the present invention also have significantly higher hardness values than those of conventional copper-nickel-zinc alloys. In the age hardened condition, from either an annealed or cold worked state, the alloys of the present invention show good ductility with hardness values over 300 Knoop.

Table 1 indicates typical mechanical properties of commercially available wrought "nickel-silver" alloys. Ultimate Tensile Strength (UTS) values for these alloys range from 92 to 110 ksi (thousand pounds per square inch). Knoop hardness values range from 201 to 236 at a 100 gram test load. Elongation is typical of a heavy cold worked wrought alloy at 1–3%.

Tables 2–6 indicate various series of the alloy of the present invention compared with one or more control alloys. The composition of each alloy is given, in weight percent, along with its Knoop hardness value under different cold-worked and heat treated conditions. Control I is a commercially available copper-nickel-zinc alloy known as "nickel-silver" alloy 65-18, or CDA 752 (65% copper-18% nickel-17% zinc), sold by many suppliers. Control II is a commercially available silver-palladium-copper-zinc alloy known as PALINEY® 2000 (44.85% silver, 29% palladium, 25% copper, 1% zinc and 0.15% boron), sold by the J. M. Ney Company. For the data contained in these tables, the annealing temperature (in ° F.) was generally selected to be approximately 80% of the alloy solidus temperature (the temperature at which the alloy has completely solidified as it is cooled from the molten state), and the aging temperature (in ° F.) was generally selected to be approximately 40% of the solidus temperature.

In Table 2, the control alloy is CDA 752. The Knoop hardness of the control alloy after 50% cold work is 201. The experimental alloys PE-417-2 through PE439 show a substantial increase in the 50% cold work hardness values as a result of the addition of about 21% palladium and small reductions in the amounts of copper, nickel, and zinc. Minor amounts of other elements are included in some alloys, as indicated. No silver is present in either the control or experimental alloys. In all cases, a substantial increase in the hardness of the experimental alloys is found after aging. The increased hardness is observed for both the cold worked plus aged as well as the annealed plus aged conditions.

In Table 3, the control alloys are CDA 752, cold worked 50%, and PALINEY® 2000, cold worked roughly 50–60%. All of the experimental alloys in this series (PE-447-2 through PE-461) show cold worked hardness values that are roughly equivalent to those of the PALINEY® 2000 alloy and superior to those of the CDA 752 alloy. The higher zinc alloys also show an age hardening reaction from both the cold worked and annealed state. Two of the experimental alloys, PE-457 and PE-458, show superior cold worked hardness relative to the CDA 752 control alloy, yet do not show a significant aging reaction. It is believed that higher zinc levels are needed to achieve an aging reaction with the specific ratios of Pd/Cu/Zn used in these alloys. This data also supports the need for a minimal zinc level for the present invention.

In Table 4, the same two control alloys are used. The hardness values of the experimental alloys in this series (PE-462 through PE-468) are roughly equivalent to those of the PALINEY® 2000 control alloy in the annealed and heat treated from annealed conditions. As with the previous experimental alloys, the cold worked hardness values of these experimental alloys are significantly higher than those of the CDA 752 control alloy which has been cold worked an equivalent amount.

It can be seen from a comparison of the CDA 752 and PALINEY® 2000 control alloys that the addition of silver and palladium, with a reduction in the amount of copper and zinc and an elimination of the nickel, produces an age hardenable alloy with superior hardness. However, relatively high levels of silver and palladium add significantly to the intrinsic cost of the alloy. It would be preferable to achieve the high hardness values by reducing the amounts of silver and palladium required and replacing these costly elements with less costly constituents such as copper, nickel and/or zinc.

A comparison of the CDA 752 control alloy and the PE-462 experimental alloy shows that the addition of palladium, with reductions in the copper and zinc levels, can account for a substantial and significant increase in the cold worked hardness of the PE-462 alloy. It was not previously known or appreciated, prior to this invention, that the addition of palladium to a copper-nickel-zinc alloy would allow for an age hardening reaction to occur that would permit further significant increases in the hardness of these alloys.

A comparison of the PALINEY® 2000 control alloy and the PE-462 experimental alloy shows that the amount of palladium can be reduced without sacrificing hardness and without requiring the addition of costly amounts of silver. In addition, in the PE462 alloy the silver has been eliminated, and the amounts of copper, nickel and zinc have been significantly increased. This formulation provides an alloy with comparable hardness and strength and a substantially reduced cost.

Table 5 contains the same two control alloys. The hardness values of the experimental alloys in this series (PE-476 through PE-486) are higher than the hardness values of the CDA 752 control alloy and are roughly equivalent to the hardness values of the PALINEY® 2000 control alloy in the cold worked and heat treat from cold worked conditions. Five of the experimental alloys (PE-476 through PE-484) are roughly equivalent in hardness values in the annealed and heat treat from annealed condition. However, for two of the experimental alloys (PE-485 and PE-486), the aging reaction is not seen in the heat treat from annealed condition. This suggests that the aging kinetics for these alloys are somewhat sluggish and may require the additional internal energy supplied by the cold work prior to aging. The aging kinetics could be improved by optimizing the solutionization and/or the aging time and temperature.

Table 6 also contains the same two control alloys. The experimental alloys in this series (PE-493 through PE-500) examine a wide range of compositional variations. The hardness values of experimental alloys PE-493 through PE-496 are found to be equivalent or superior to those of the PALINEY® 2000 control alloy in all conditions. The remaining experimental alloys in the table show a diminished age hardening response. Alloys PE-497 through PE-500 do age harden from the annealed condition; however, they soften slightly when heated from the cold worked condition. The aging response in these alloys could also be improved by optimizing the solutionization and/or the aging time and temperature.

Table 7 contains experimental alloys PE-477 through PE-480, which contain much higher silver contents than the experimental alloys shown in the other tables. Relative to the PALINEY® 2000 control alloy, the palladium and copper levels in the experimental alloys of Table 7 are comparable, but some of the silver has been replaced with zinc. At these silver and zinc levels, the experimental alloys do not show an aging response from either the cold worked or annealed condition. However, these alloys also show cold worked hardness values that are superior to those of prior art copper-nickel-zinc alloys.

Table 8 indicates typical mechanical properties for one of the preferred embodiments of the present invention, experimental alloy PE462 (47.5% copper, 19.56% nickel, 9.78% zinc, and 23.26% palladium). The ultimate tensile strength and hardness values of the annealed PE-462 alloy are comparable to those for the cold worked "nickel-silver" alloys shown in Table 1. Both the heat treated and the cold worked mechanical properties of the PE-462 alloy are superior to those of any of the "nickel-silver" alloys shown in Table 1. Heat treated tensile strength properties for the PE-462 alloy are roughly 50% higher than those of the cold worked "nickel-silver" alloys. Hardness values for the cold worked PE-462 alloy show at least a 10improvement over the hardness values of the best "nickel-silver" alloy (CDA 770). The heat treated hardness for the PE462 alloy represents a 40% increase over the value obtained for the cold worked CDA 770 alloy.

Table 9 contains comparative stress relaxation data for the experimental PE-462 alloy and the CDA 752 control alloy. Both alloys were tested at 200° C. Since stress relaxation properties are known to degrade as materials approach their yield points, three different stress levels (representative of increasing amount of time in which the sample was subjected to test conditions) were selected for this test. In the table, these levels are reported both in terms of the absolute stress value and as a percentage of the alloy's yield strength. For any given exposure period, the higher the % stress remaining, the less spring force will be lost when used at the test temperature. The PE-462 alloy is superior to the CDA 752 control alloy in stress relaxation properties at all stress levels.

Thus, it can be seen from the forgoing detailed specification that the present invention provides a novel family of copper-nickel-zinc-palladium alloys for use in miniature sliding and static electrical contact applications. The alloys of the present invention exhibit strength, hardness and stress relaxation performance values, obtainable through heat treating from either the cold worked or annealed condition, which are superior to those values which are obtained from prior art "nickel-silver" alloys.

Additionally, similar and other alloys with higher silver levels and lower nickel levels than those of the age hardenable alloys show marked improvements in strength and hardness values relative to those of the prior art copper-nickel-zinc alloys and are also considered to be within the scope of the present invention.

Because certain changes may be made in the above apparatus without departing from the scope of the invention herein disclosed, it is intended that all matter contained in the above description or shown in the accompanying drawings shall be interpreted in an illustrative and not a limiting sense.

TABLE I

Mechanical Properties of Commercial Nickel Silver Alloys

| | Composition | | | Temper | UTS | Hardness | | Elongation |
|---|---|---|---|---|---|---|---|---|
| CDA alloy | Cu— | Ni— | Zn | (strip) | (Ksi) | Rb | Hk | (%) |
| 745 | 65 | 10 | 25 | Ex. Hard | 95 | 92 | 211 | 3 |
| 752 | 65 | 18 | 17 | Ex. Hard | 92 | 90 | 201 | 3 |
| 754 | 65 | 15 | 20 | Ex. Hard | 92 | 90 | 201 | 2 |
| 757 | 65 | 12 | 23 | Ex. Hard | 93 | 92 | 211 | 2 |

TABLE I-continued

Mechanical Properties of Commercial Nickel Silver Alloys

| | Composition | | | Temper | UTS | Hardness | | Elongation |
|---|---|---|---|---|---|---|---|---|
| CDA alloy | Cu— | Ni— | Zn | (strip) | (Ksi) | Rb | Hk | (%) |
| 770 | 65 | 18 | 27 | Ex. Hard | 110 | 97 | 236 | 1 min. |

Notes:

1. Extra hard temper is achieved by an approximately 50% reduction in strip thickness through cold working.

2. Hardness scales are Rockwell B (Rb) and Knoop (Hk).

TABLE 2

| Alloy | Composition (weight %) | | | | | | | Hardness ($HK_{100}$) | | | |
|---|---|---|---|---|---|---|---|---|---|---|---|
| Code | Pd | Ag | Cu | Ni | Zn | Other | Other | 50% CW | HT from CW | Ann'd | HT from Ann'd |
| 65-18 | — | — | 65 | 18 | 17 | — | — | 201 | — | — | — |
| PE-417-2 | 21.5 | — | 51.5 | 14.0 | 13.0 | — | — | 283 | 372 | 183 | 375 |
| PE-422-2 | 21.5 | — | 51.0 | 13.5 | 12.5 | Cr 1.5 | — | 288 | 362 | 172 | 280 |
| PE-431 | 21.5 | — | 51.5 | 14.0 | 12.95 | Sb 0.05 | — | 294 | 382 | 187 | 380 |
| PE-432 | 21.5 | — | 51.5 | 14.0 | 12.5 | Co 0.5 | — | 288 | 375 | 185 | 379 |
| PE-433 | 21.5 | — | 51.5 | 14.0 | 12.5 | Sn 0.5 | — | 300 | 385 | 189 | 387 |
| PE-434 | 21.5 | — | 51.5 | 14.0 | 12.5 | Ru 0.5 | — | 296 | 381 | 189 | 375 |
| PE-435 | 18.5 | — | 51.5 | 14.0 | 13.0 | Au 3.0 | — | 287 | 369 | 185 | 355 |
| PE-436 | 21.5 | — | 51.5 | 14.0 | 12.5 | Zr 0.5 | — | 292 | 381 | 183 | 376 |
| PE-437 | 21.5 | — | 51.5 | 14.0 | 12.5 | Ge 0.5 | — | 297 | 369 | 189 | 368 |
| PE-438 | 21.5 | — | 51.0 | 13.5 | 12.45 | Cr 1.5 | Sb 0.05 | 294 | 373 | 168 | 252 |
| PE-439 | 21.0 | — | 50.0 | 13.0 | 10.0 | Cr 1.0 | Ru 5.0 | 297 | 380 | 191 | 281 |

Notes:
1. 65-18 = Nickel Silver Alloy 65-18 = Nickel Silver "A" = CDA 752
2. ECCO cast plate, 4¾ × ½ × 3/16".
3. All alloys tested at .020" thick.

TABLE 3

| Alloy | Composition (weight %) | | | | | | | Hardness ($HK_{100}$) | | | |
|---|---|---|---|---|---|---|---|---|---|---|---|
| Code | Pd | Ag | Cu | Ni | Zn | Other | Other | | HT from CW | Ann'd | HT from Ann'd |
| | | | | | | | | 50% CW | | | |
| 65-18 | — | — | 65 | 18 | 17 | — | — | 201 | — | — | — |
| Pal 2000 | 29.0 | 44.85 | 25.0 | — | 1.0 | B 0.15 | — | 270–300 | 300–360 | 190–270 | 300–360 |
| | | | | | | | | 43% CW | | | |
| PE-447-2 | 22.5 | — | 45.0 | 20.0 | 12.5 | — | — | 308 | 370 | 209 | 360 |
| PE-452 | 22.5 | 0.5 | 45.0 | 20.0 | 12.0 | — | — | 302 | 384 | 202 | 378 |

TABLE 3-continued

| Alloy Code | Composition (weight %) Pd | Ag | Cu | Ni | Zn | Other | Other | Hardness ($HK_{100}$) | HT from CW | Ann'd | HT from Ann'd |
|---|---|---|---|---|---|---|---|---|---|---|---|
| PE-453 | 22.5 | 1.0 | 45.0 | 20.0 | 11.5 | — | — | 306 | 381 | 212 | 386 |
| PE-454 | 22.5 | — | 50.5 | 17.0 | 10.0 | — | — | 300 | 366 | 178 | 359 |
| PE-455 | 22.5 | — | 47.5 | 20.0 | 10.0 | — | — | 309 | 364 | 195 | 354 |
| PE-456 | 22.5 | — | 47.5 | 17.5 | 12.5 | — | — | 310 | 370 | 194 | 374 |
| PE-457 | 22.5 | — | 47.5 | 25.0 | 5.0 | — | — | 301 | 302 | 179 | 188 |
| PE-458 | 22.5 | 0.5 | 47.0 | 25.0 | 5.0 | — | — | 297 | 306 | 177 | 199 |
| PE-459 | 22.5 | 1.0 | 50.5 | 11.0 | 15.0 | — | — | 318 | 373 | 208 | 364 |
| PE-460 | 22.5 | — | 40.0 | 25.0 | 12.5 | — | — | — | — | — | — |
| PE-461 | 22.5 | 1.0 | 50.5 | 17.0 | 9.0 | — | — | 295 | 373 | 175 | 332 |

Notes:
1. 65-18 = Nickel Silver Alloy 65-18 = Nickel Silver "A" = CDA 752
2. ECCO cast plate, 4¾ × ½ × 3/16".
3. All alloys tested at .020" thick
4. PE-460 broke up at .106" thick.

TABLE 4

| Alloy Code | Composition (weight %) Pd | Ag | Cu | Ni | Zn | Other | Hardness ($HK_{100}$) | HT from CW | Ann'd | HT from Ann'd |
|---|---|---|---|---|---|---|---|---|---|---|
| | | | | | | | 50% CW | | | |
| 65-18 | — | — | 65 | 18 | 17 | — | 201 | — | — | — |
| Pal 2000 | 29.0 | 44.85 | 25.0 | — | 1.0 | B0.15 | 270–300 | 300–360 | 190–270 | 300–360 |
| | | | | | | | 40% CW | | | |
| PE-462 | 23.16 | — | 47.50 | 19.56 | 9.78 | — | 299 | 372 | 198 | 350 |
| PE-463 | 24.75 | — | 47.50 | 18.50 | 9.25 | — | 304 | 367 | 210 | 346 |
| PE-464 | 26.40 | — | 47.50 | 17.00 | 9.10 | — | 304 | 361 | 210 | 301 |
| PE-465 | 24.75 | 0.20 | 47.50 | 18.40 | 9.15 | — | 300 | 371 | 202 | 306 |
| PE-466 | 24.75 | — | 47.50 | 18.40 | 9.15 | Ge0.20 | 303 | 364 | 212 | 271 |
| PE-467 | 23.16 | 0.20 | 47.50 | 19.43 | 9.71 | — | 304 | 377 | 205 | 303 |
| PE-468 | 23.16 | — | 47.50 | 19.43 | 9.71 | Ge0.20 | 308 | 377 | 209 | 340 |

Notes:
1. 65-18 = Nickel Silver Alloy 65-18 = Nickel Silver "A" = CDA 752
2. ECCO cast plate, 6 × ½ × ¼".
3. All alloys tested at .020" thick

TABLE 5

| Alloy Code | Composition (weight %) Pd | Ag | Cu | Ni | Zn | Other | Other | Hardness ($HK_{100}$) | HT from CW | Ann'd | HT from Ann'd |
|---|---|---|---|---|---|---|---|---|---|---|---|
| | | | | | | | | 50% CW | | | |
| 65-18 | — | — | 65 | 18 | 17 | — | — | 201 | — | — | — |
| Pal 2000 | 29.0 | 44.85 | 25.0 | — | 1.0 | B 0.15 | — | 270–300 | 300–360 | 190–270 | 300–360 |
| | | | | | | | | 40% CW | | | |
| PE-476 | 26.20 | — | 47.50 | 18.82 | 7.48 | — | — | 295 | 358 | 188 | 283 |
| PE-481 | 23.02 | 5.00 | 50.70 | 11.03 | 10.25 | — | — | 312 | 385 | 192 | 374 |
| PE-482 | 23.18 | 2.50 | 50.00 | 13.49 | 10.83 | — | — | 288 | 392 | 183 | 378 |
| PE-483 | 26.15 | 5.00 | 48.50 | 9.70 | 10.65 | — | — | 294 | 379 | 206 | 364 |

TABLE 5-continued

| Alloy Code | Composition (weight %) Pd | Ag | Cu | Ni | Zn | Other | Other | Hardness ($HK_{100}$) | HT from CW | Ann'd | HT from Ann'd |
|---|---|---|---|---|---|---|---|---|---|---|---|
| PE-484 | 26.20 | 2.50 | 50.00 | 11.80 | 9.50 | — | — | 298 | 362 | 187 | 341 |
| PE-485 | 10.00 | 2.50 | 49.00 | 20.50 | 8.00 | Au 8.00 | Pt 2.00 | 278 | 309 | 171 | 175 |
| PE-486 | 15.00 | 1.00 | 49.00 | 24.00 | 5.00 | Au 5.00 | Pt 1.00 | 285 | 315 | 169 | 184 |

Notes:
1. 65-18 = Nickel Silver Alloy 65-18 = Nickel Silver "A" = CDA 752
2. ECCO cast plate, 6 × ½ × ¼".
3. All alloys tested at .020" thick

TABLE 6

| Alloy Code | Composition (weight %) Pd | Ag | Cu | Ni | Zn | Other | Hardness ($HK_{100}$) | HT from CW | Ann'd | HT from Ann'd |
|---|---|---|---|---|---|---|---|---|---|---|
| | | | | | | | 50% CW | | | |
| 65-18 | — | — | 65 | 18 | 17 | — | 201 | — | | |
| Pal 2000 | 29.0 | 44.85 | 25.0 | — | 1.0 | B0.15 | 270–300 | 300–360 | 190–270 | 300–360 |
| | | | | | | | 40% CW | | | |
| PE-493 | 23.0 | — | 42.0 | 25.0 | 10.0 | — | 307 | 368 | 202 | 330 |
| PE-494 | 23.0 | — | 37.0 | 25.0 | 15.0 | — | 319 | 356 | 223 | 333 |
| PE-495 | 23.0 | 2.5 | 39.5 | 25.0 | 10.0 | — | 333 | 414 | 201 | 409 |
| PE-496 | 35.0 | — | 30.0 | 25.0 | 10.0 | — | 375 | 403 | 253 | 303 |
| PE-497 | 10.0 | — | 60.0 | 10.0 | 20.0 | — | 248 | 233 | 152 | 177 |
| PE-498 | 10.0 | — | 65.0 | 10.0 | 15.0 | — | 239 | 233 | 134 | 176 |
| PE-499 | 10.0 | — | 70.0 | 5.0 | 15.0 | — | 224 | 212 | 114 | 173 |
| PE-500 | 10.0 | 2.5 | 62.0 | 10.0 | 15.5 | — | 242 | 237 | 126 | 193 |

Notes:
1. 65-18 = Nickel Silver Alloy 65-18 = Nickel Silver "A" = CDA 752
2. ECCO cast plate, 6 × ½ × ¼".
3. All alloys tested at .053" thick
4. PE-495 & 496 broke up during rolling. PE-494 had many large cracks.

TABLE 7

| Alloy Code | Composition (weight %) Pd | Ag | Cu | Ni | Zn | Other | Hardness ($HK_{100}$) | HT from CW | Ann'd | HT from Ann'd |
|---|---|---|---|---|---|---|---|---|---|---|
| | | | | | | | 50% CW | | | |
| 65-18 | — | — | 65 | 18 | 17 | — | 201 | | | |
| Pal 2000 | 29.0 | 44.85 | 25.0 | — | 1.0 | B 0.15 | 270–300 | 300–360 | 190–270 | 300–360 |
| | | | | | | | ~25% CW | | | |
| PE-477 | 24.70 | 32.05 | 32.00 | — | 11.25 | — | 233 | 231 | 181 | 185 |
| PE-478 | 26.00 | 25.00 | 24.00 | — | 25.00 | — | 239 | 251 | 185 | 186 |
| PE-479 | 25.25 | 22.25 | 36.35 | 4.39 | 11.76 | — | 245 | 255 | 216 | 220 |
| PE-480 | 26.00 | 30.00 | 15.00 | — | 29.00 | — | 234 | 230 | 156 | 172 |

Notes:
1. 65-18 = Nickel Silver Alloy 65-18 = Nickel Silver "A" = CDA 752
2. ECCO cast plate, 6 × ½ × ¼".

TABLE 7-continued

| Alloy Code | Composition (weight %) Pd | Ag | Cu | Ni | Zn | Other | Hardness ($HK_{100}$) HT from CW | Ann'd | HT from Ann'd |
|---|---|---|---|---|---|---|---|---|---|

3. Due to cracking, processing was stopped and hardness readings were obtained at various thicknesses (approx. 25% CW).

TABLE 8

| Condition | Mechanical Properties of 0.057" dia. Alloy PE 462 Wire: Modulus ($\times 10^6$ psi) | UTS (1000 psi) | Prop. Limit (1000 psi) | .2% Y.S. (1000 psi) | Elongation (%) | Hardness ($HK_{100}$) |
|---|---|---|---|---|---|---|
| 57% CW | 18.0 | 157.0 | 136.1 | 148.1 | 1.9 | 275 |
| HT from CW | 18.0 | 175.8 | 146.4 | 159.6 | 7.8 | 371 |
| Annealed | 18.0 | 100.0 | 61.3 | 61.5 | 39.4 | 201 |
| HT from Ann'd | 18.0 | 162.3 | 129.4 | 140.0 | 19.3 | 353 |

Notes:
1. Heat treatment — 810° F./60 minutes
2. Anneal — 1580° F./30 minutes

TABLE 9

Stress Relaxation Performance (Tests performed at 200° C.)

| Material | Composition | Condition | Initial Stress Ksi | % YS | % Stress Remaining 1 Hr. | 8 Hr | 100 Hr. |
|---|---|---|---|---|---|---|---|
| CDA 752 | 65%Cu—18%Ni—17%Zn | Extra Spring | 75 | 69 | 60.51 | 52.65 | 38.03 |
| | | | 100 | 92 | 54.1 | 46.61 | 33.64 |
| | | | 120 | 110 | 49.25 | 42.41 | 30.42 |
| PE-462 | 47.5%Cu—23.16%Pd—19.56%Ni—9.78%Zn | Age Hardened From CW | 75 | 56.3 | 92.37 | 88.06 | 79.34 |
| | | | 100 | 75 | 87.89 | 82.83 | 72.86 |
| | | | 120 | 90 | 83.43 | 78.17 | 67.54 |

Notes:
1. Yield Strength for CDA 752 — 108,000 psi
2. Yield Strength for PE-462 — 133,000 psi

What is claimed is:

1. An age hardenable Cu—Ni—Zn—Pd alloy comprising, by weight, about 30–65 percent copper, about 5–30 percent nickel, about 5–20 percent zinc, about 5–45 percent palladium, and up to about 10 percent silver.

2. An age hardenable Cu—Ni—Zn—Pd alloy according to claim 1, wherein silver comprises not greater than about 5 percent by weight, and zinc comprises at least 6 percent by weight.

3. An age hardenable Cu—Ni—Zn—Pd alloy according to claim 2, further comprising up to one percent by weight of one or more elements selected from the group consisting of gold, antimony, germanium, cobalt, tin, ruthenium, zirconium, chromium and boron.

4. An age hardenable Cu—Ni—Zn—Pd alloy according to claim 3, further comprising less than one percent by weight of a grain refining element.

5. An age hardenable Cu—Ni—Zn—Pd alloy according to claim 4, wherein the grain refining element is selected from the group consisting of rhenium and iridium.

6. An age hardenable Cu—Ni—Zn—Pd alloy, comprising, by weight, about 35–60 percent copper, about 9–25 percent nickel, about 7.5–15 percent zinc, about 15–40 percent palladium, and up to about 5 percent silver.

7. An age hardenable Cu—Ni—Zn—Pd alloy, consisting essentially of, by weight, about 47.5% percent copper, about 19.56% percent nickel, about 9.78% percent zinc, and about 23.16% percent palladium.

8. A sliding electrical contact made from an age hardenable Cu—Ni—Zn—Pd alloy, comprising, by weight, about 30–65 percent copper, about 5–30 percent nickel, about 5–20 percent zinc, about 5–45 percent palladium, and up to about 10 percent silver.

9. A static electrical contact made from an age hardenable Cu—Ni—Zn—Pd alloy, comprising, by weight, about 30–65 percent copper, about 5–30 percent nickel, about 5–20 percent zinc, about 5–45 percent palladium, and up to about 10 percent silver.

* * * * *